United States Patent [19]

Sadler et al.

[11] Patent Number: 4,910,636

[45] Date of Patent: Mar. 20, 1990

[54] STATIC ELECTRICITY DISSIPATOR

[75] Inventors: Charlton Sadler, Brooksville; Bruce Kaiser, Clearwater, both of Fla.

[73] Assignee: Lightning Master Corporation, Brooksville, Fla.

[21] Appl. No.: 198,144

[22] Filed: May 24, 1988

[51] Int. Cl.[4] ..... H05F 3/02

[52] U.S. Cl. ..... 361/221; 174/3; 174/4 R

[58] Field of Search ..... 361/212, 216, 217, 218, 361/220, 221, 222; 174/2, 3, 4 R

[56] References Cited

U.S. PATENT DOCUMENTS

| | | | |
|---|---|---|---|
| 2,631,189 | 3/1953 | Sullivan et al. | 361/218 |
| 3,617,805 | 11/1971 | Truax | 361/218 X |
| 4,605,814 | 8/1986 | Gillem | 174/4 R X |

FOREIGN PATENT DOCUMENTS

| | | | |
|---|---|---|---|
| 284311 | 4/1931 | Italy | 174/2 |

*Primary Examiner*—L. T. Hix
*Assistant Examiner*—Brian W. Brown
*Attorney, Agent, or Firm*—Dominik, Stein, Saccocio, Reese, Colitz & VanDerWall

[57] ABSTRACT

An electrical dissipator comprising a multiplicity of fine electrically conductive wires having their proximate ends fitted into a hole in an electrically conductive base member and secured therein by crimping to securely grip the ends of the wires. One embodiment of the base member comprises a hollow tube allowing connection over an existing traditional lightning rod. In another embodiment, the base member comprises a solid rod or hollow tube having its proximal end threaded to allow the traditional lightning rod to be unthreaded from its threaded base and replaced. In a third embodiment, the base member comprises an apertured flange for bolting to the structure to be protected from lightning.

10 Claims, 3 Drawing Sheets

STATIC ELECTRICITY DISSIPATOR

BACKGROUND OF THE INVENTION

1. Field of the Invention

This invention relates to static electric dissipators for preventing lightning strikes to structures such as buildings, towers and land or water craft. More particularly, this invention relates to electric dissipators having a multiplicity of single strands of wire allowing the static dissipation of electrical ground charges to the atmosphere to minimize the electrical potential between the clouds and the structure.

2. Description of the Background Art

Lightning is the result of the interaction between different electrical potentials within the clouds and between clouds and earth. Friction caused by rising and descending air currents within storm clouds produces electrical charges in those clouds. Electrical potential varies between regions within the clouds and between clouds and the earth. When the potential gradient becomes high enough to overcome the resistance of the intervening air, a lightning strike occurs.

As a charged cloud travels through the atmosphere, it is followed by a shadow of oppositely charged particles on the ground. These charged particles attempt to reach the oppositely charged particles in the cloud, thereby producing lightning.

The traditional lightning rod comprises a pointed straight metal rod which is mounted preferably to the tallest areas of the structure. Typically, a multitude of lightning rods are mounted to the upper areas of a structure and connected electrically to earth ground by means of a braided copper cable.

The traditional lightning rod affords protection in two ways. It dissipates electrical charge to the atmosphere, thereby decreasing the buildup of electrical potential and reducing the possibility of a strike. Unfortunately, such lightning rods only have one point for dissipation of electrons to the atmosphere. Moreover, the point quickly dulls upon exposure to the atmosphere thereby reducing its effectiveness to dissipate charges. When the buildup of electrical potential exceeds the dissipation ability of the lightning, the rod becomes saturated, attracts the lightning strike and conveys the electrical energy to ground.

The traditional lightning rod is universally accepted as preventing physical damage to the structure during a lightning strike. Notwithstanding, the traditional lightning rod does not prevent other types of electrical damage. Specifically, it has been known that a lightning strike actually consists of a series of discharges which produces rapidly expanding and contracting electromagnetic fields which induce electrical currents in nearby wires and electrical equipment. While vacuum tube equipment was relatively unaffected by such induced currents, solid state electronic devices can be easily damaged. In fact, a semiconductor microprocessor can be damaged by a nearby electrical strike even if it is not in use or connected to a power source.

In view of the foregoing, it has been recognized that meaningful lightning protection is achieved by dissipating sufficient charges to the atmosphere to minimize the electrical potential between the earth and the atmosphere so that, optimally, a lightning strike never occurs. Hence, many lightning dissipators or deterrents have been developed with the primary objective of dissipating electrons to the atmosphere. For example, U.S. Pat. No. 4,605,814 discloses a lightning deterrent which consists of a cable having a multiplicity of fine conductive wires captured within the strands of the cable to emanate therefrom in a brush-like manner. During use, the cable is formed in a circular or other configuration and mounted about the periphery of the structure to be protected. The terminal ends of the multiplicity of fine conductive wires function to dissipate electrons to the atmosphere, thereby minimizing the electrical potential differential between the structure and the atmosphere. The likelihood of a lightning strike is therefore minimized.

The lightning deterrent disclosed in U.S. Pat. No. 4,605,814 is intended to be formed into an annulus having a diameter sufficient to contain the vertical sides of the tower to be protected. Obviously, the intended use of such lightning deterrent would not be practical for large structures such as buildings in that a single cable extending about the building's periphery may not sufficiently dissipate electrons to the atmosphere.

Therefore, it is an object of this invention to provide an apparatus which overcomes the aforementioned inadequacies of the prior art devices and provides an improvement which is a significant contribution to the advancement of the electrostatic dissipator art.

Another object of this invention is to provide an electrical dissipator to minimize lightning strikes to a structure such as a building, tower or vehicle.

Another object of this invention is to provide an electrical dissipator having a multiplicity of fine conductive wires emanating from a base member to facilitate the dissipation of electrons to the atmosphere, thereby minimizing the electrical potential differential between the structures and the atmosphere to reduce the likelihood of a lightning strike to the structure.

Another object of this invention is to provide an electrical dissipator having a multiplicity of fine conductive wires emanating from a base, allowing the base to be attached to various areas of the structure to be protected from lightning strikes.

Another object of this invention is to provide an electrical dissipator having a multiplicity of fine conductive wires emanating from a base consisting of a tube dimensioned to be slid over an existing traditional lightning rod and be crimped thereto to convert the traditional lightning rod having a single dissipator point to one having a multiplicity of dissipator points.

Another object of this invention is to provide a method for manufacturing the fine conductive wires of an electrical dissipator such that the fine conductive wires are heat-tempered in a relatively straight configuration to reduce the tendency of the wires to deform and become tangled with one another.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a static electric dissipator for dissipating electrical energy from a structure to the atmosphere to minimize the electrical potential differential between the structure and the atmosphere such that the likelihood of a lightning strike to the structure is minimized. More particularly, the electrical dissipator of the invention comprises a multiplicity of fine electrically conductive wires having their proximal ends fitted into a hole in an electrically conductive base member and secured therein by crimping the base member inwardly to securely grip the ends of the wires.

In one embodiment, the base member comprises a hollow tube manufactured from a conductive material such as copper (which may be nickel plated). During use, the copper tube is slid over an existing traditional lightning rod. The tube is then crimped about the lightning rod to rigidly secure the tube thereto while forming an electrical connection between the tube and the existing lightning rod. In another embodiment, the base member may comprise a solid rod or hollow tube having its proximal end threaded, allowing the traditional lightning rod to be unthreaded from its threaded base and replaced by the electrical dissipator of this invention. Alternatively, a threaded plug may be crimped in the tube for threaded engagement with a conventional threaded base. Finally, in a third embodiment, the base member may comprise an apertured flange to be bolted to any part of the structure to be protected.

The invention also comprises a novel method for producing the fine strands of wire to be connected to the base member. More particularly, the method of the invention comprises continuously running a strand of the fine wire from a supply spool through a heat source, such as a kiln, onto a large diameter spool. After sufficient wire has accumulated on the large diameter take-up spool, the bundle of wire about the take-up spool is banded about the rim of the spool at distances equal to the intended length of each strand of wire. The bundle of wire is then cut at each point of banding to produce the desired length of wires. Standoffs may be provided about the periphery of the rim of the take-up spool to provide a gap between the rim and the bundled wire to facilitate cutting the bundles.

The method of this invention functions to heat-temper and straighten the fine conductive wire from the supply spool without which the fine wire would retain the curvature of the supply spool and quickly entangle with other wires once installed in the base member as described above.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1A:
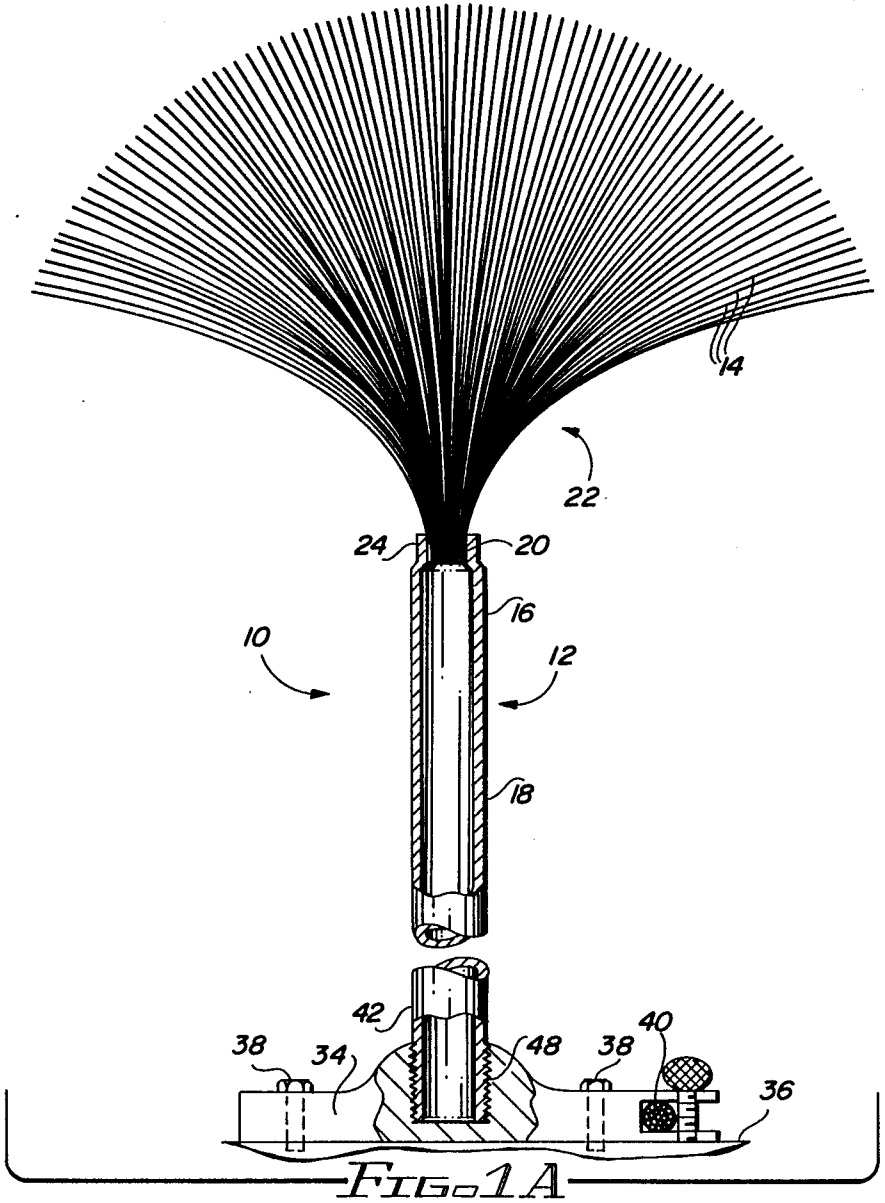
FIG. 1A is a partial cross-sectional view of the proximal end of the second embodiment of the electrical dissipator of the invention adapted to be threaded into a mounting base for a traditional lightning rod.

The electrical dissipator 10 of the invention comprises a electrically conductive base member, generally indicated by numeral 12, having a plurality of fine conductive wires 14 emanating from the upper end 16 of the base member 12. Fine conductive wires 14 may be produced by the method of the invention described hereinafter, such that the wires 14 are heat-tempered in a straight configuration. In this manner, the wires 14 will emanate from the base member 12 in a uniform, mushroom-shape manner as shown in FIG. 1. Preferably, wires 14 are approximately 0.005 inches in diameter and are manufactured from 316 stainless steel, or other high quality steel.

The base member 12 of the first embodiment of the electrical dissipater 10 comprises a conductive tube manufactured from hard copper or other electrically conductive material. The proximal end 20 of a bundle 22 of wires 14 is inserted into the upper end 16 of the tube 18. The proximal end 20 of the bundle 22 of wires 14 is then crimped within the upper end 16 of the tube 18 through the use of a cable crimper or the like (not shown). The resulting crimp 24 sincerely retains the proximal ends 20 of the wires 14 within the upper end 16 of the tube 18. Additionally, crimp 24 forms an electrical connection among the proximal ends 20 of the wires 14 with the upper end 16 of the tube 18 allowing electrical energy to flow from the tube 18 to the wires 14.

Traditional lightning rods 26 typically consist of a solid or hollow rod 28 having its terminal end 30 pointed and its lower end 32 threaded for threaded engagement into a lightning rod base 34. The lightning rod base 34 is mounted to the roof 36 of the structure to be protected by bolt 38 or similar fasteners. Each lightning rod base 34 is electrically connected with the others and to earth/ground by a braided copper cable 40.

The electrical dissipater 10 of the invention is easily used in conjunction with the conventional lightning rods 28 by simply slipping the lower end 42 of the base member 12 over the terminal end 30 of the lightning rod 20, until the lightning rod 20 fully extends into the inside of the tube 18. Of course, the inner diameter of tube 18 should be marginally greater than the outer diameter of the lightning rod 28. The tube 18 of the electrical dissipater 10 on the invention is mechanically and electrically connected to the lightning rod 28 by crimping the tube 18 about the rod 28 using a conventional cable crimper or the like. One or more of such crimps 44 may be formed.

During operation, electrical energy from the structure flows from the lightning rod base 34, through the lightning rod 28 and tube 18 to the wires 14 to be dissipated to the atmosphere at each terminal end 46 of the multiplicity of wires 14. Thus, it can be readily appreciated that the great number of wires 14 and the solid electrical connection between the wires 14 and the lightning rod base 34 via tube 18 and lightning rod 28, assures that maximum dissipation of electrical charge to the atmosphere will be achieved. Moreover, it can be readily appreciated that the electrical dissipater 10 of the invention can be quickly and easily installed on existing structures having traditional lightning rods 26 through the use of a simple cable crimper.

Figure 1:
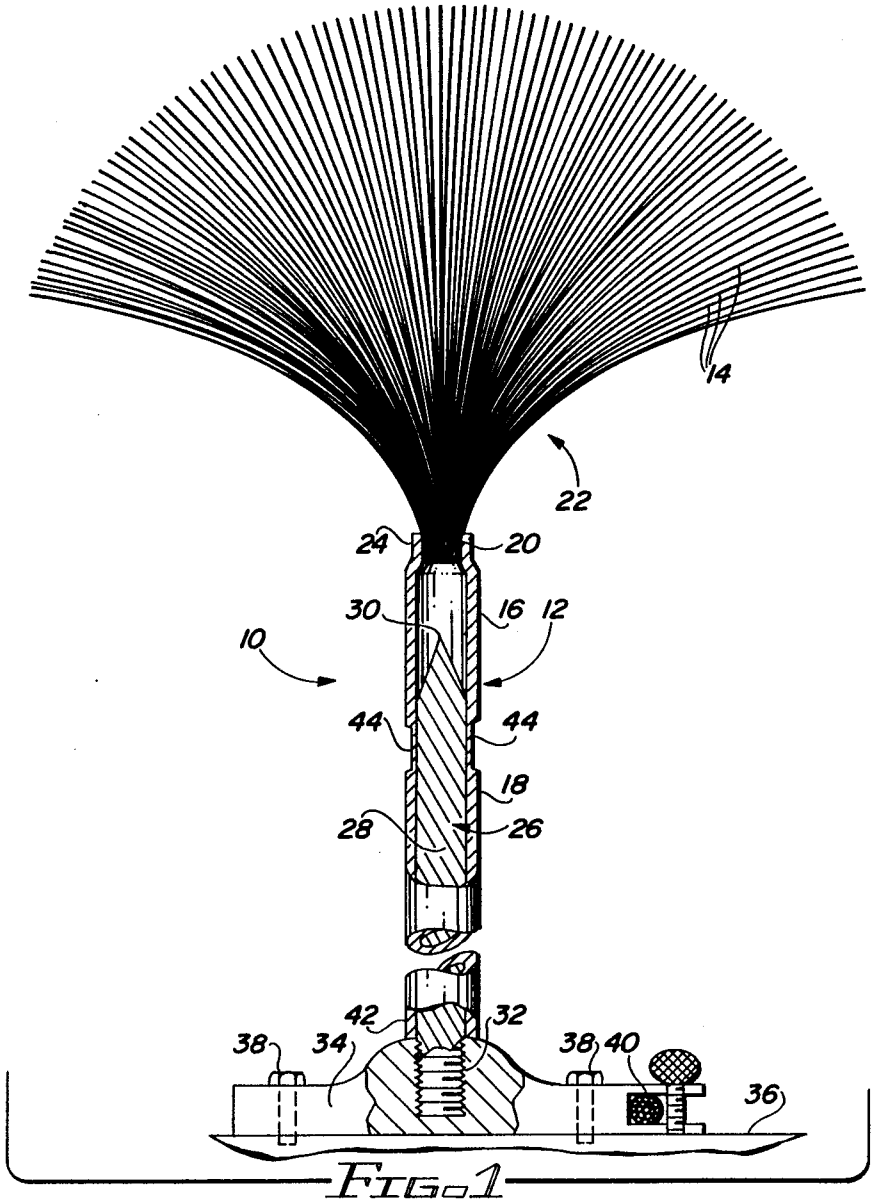
FIG. 1 is a side view, partially in section, of the first embodiment of the electrical dissipator of the invention fitted over an existing traditional-type lightning rod.
Figure 1C:
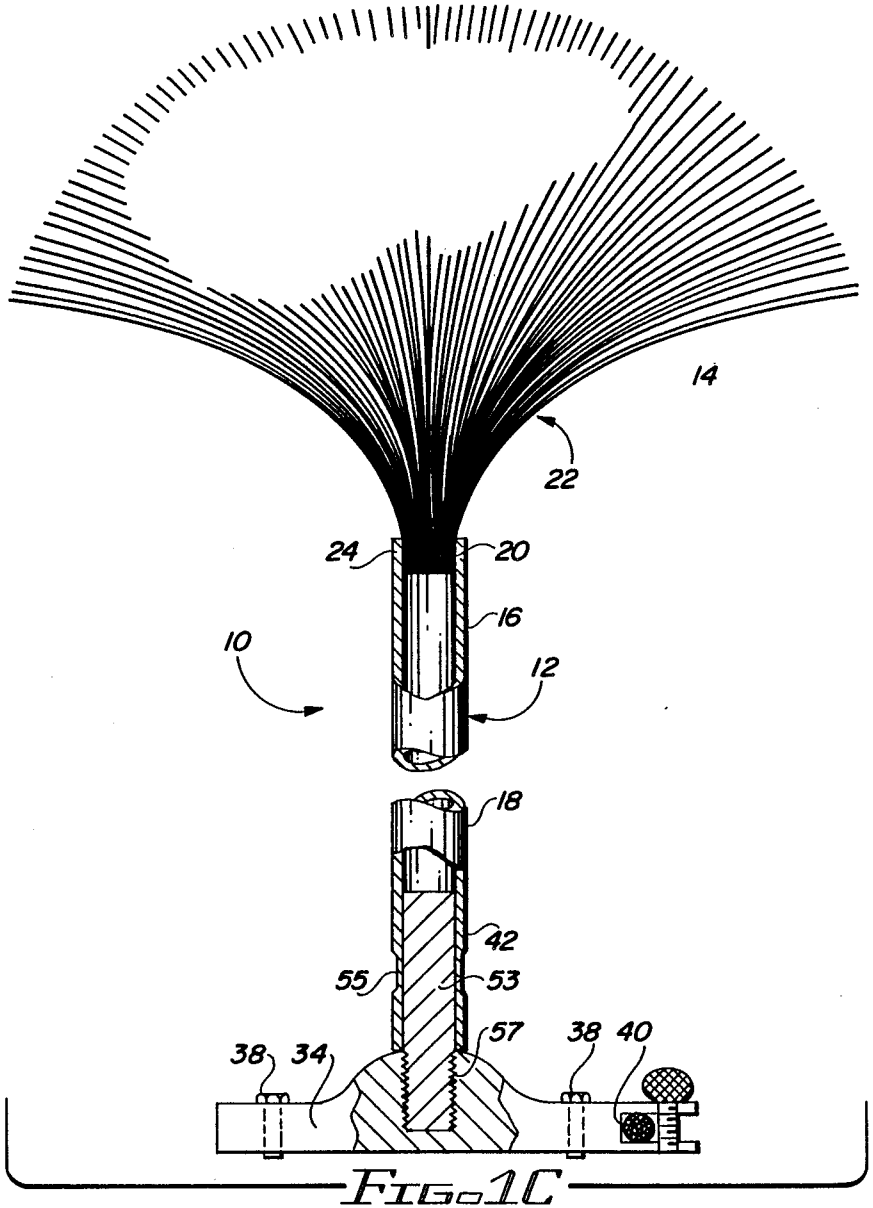
FIG. 1C is a partial cross-sectional view of the fourth embodiment of the invention comprising a tube having a threaded plug crimped in its lower end for threaded engagement into a mounting base for a traditional lightning rod.
Figure 1B:
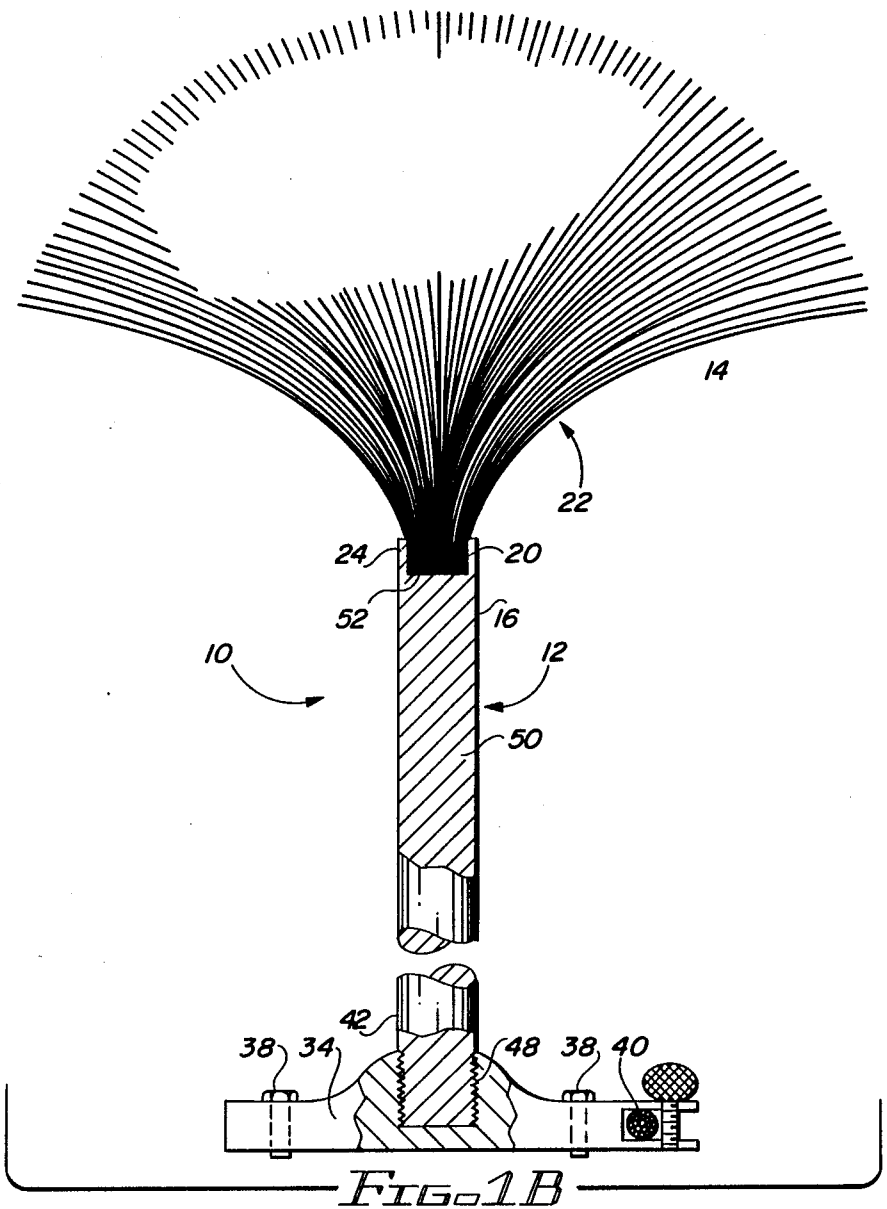
FIG. 1B is a partial cross-sectional view of the third embodiment electrical dissipator of the invention comprising a solid rod for threaded engagement into a mounting base for a traditional lightning rod.

FIGS. 1A, 1B and 1C illustrate a second, third and fourth embodiments of the base member 12 of the electrical dissipater 10 of the invention particularly adapted to be used in connection with newly installed or existing lightning rod bases 34. More particularly, as shown in FIG. 1A, base member 12 comprises a tube 18 as described above having its lower end 42 threaded 48 for threaded engagement with the lightning rod base 34. Similarly, the base member 12 as shown in FIG. 1B comprises a solid rod 50 having a blind hole 52 in its upper end 16 for receiving the proximal ends 20 of the wires 14 therein, and for crimping at crimp 24 as describer hereinabove. The lower end 42 of the base member 12 similarly includes a thread 48 for threaded engagement with the lightning rod base 34. Finally, as shown in FIG. 1C, a threaded plug 53 may be inserted into the tube 18 and crimped 55 as described above, with the lower threaded end of plug 53 being adapted for threaded engagement 57 with the lightning rod base 34.

In the embodiments of the base member 12 as shown in FIGS. 1A, 1B, and 1C, it is readily apparent that in new construction, traditional lightning rod bases 34 may be installed throughout the roof 36 of the structure and interconnected by the cable 40 in the conventional manner. Then, the base member 12 of the electrical dissipater 10 may be simply threaded therein in lieu of the traditional lightning rods 28. The electrical dissipaters 10 may also be used as replacements for damaged conventional lightning rods 28 for existing installations.

Figure 2A:
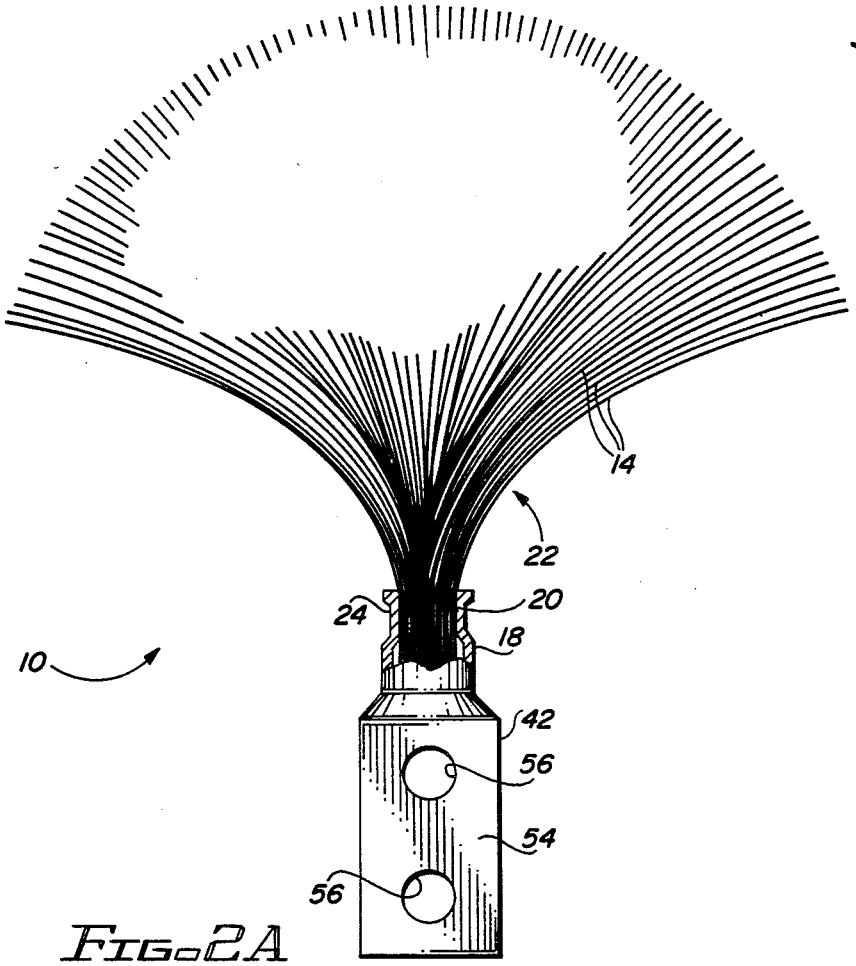
FIG. 2A is a partial front view of FIG. 2.
Figure 2:
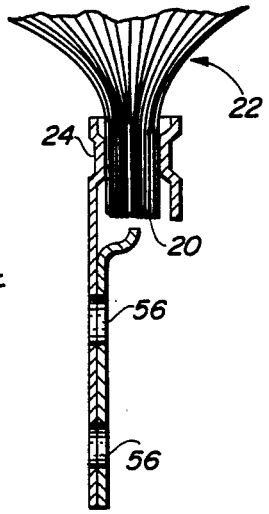
FIG. 2 is a side view of the fifth embodiment of the electrical dissipator of the invention adapted to be bolted the structure to be protected.

As shown in FIGS. 2 and 2A, the fifth embodiment of the electrical dissipater 10 of the invention comprises an ordinary electrical end connector having a tube 18 into which the proximal ends 20 of the wires 14 are inserted and crimped 24 therein. The lower end 42 of the tube is flattened to form a flat bracket 54. Holes 56 may be stamped into bracket 54 allowing the bracket 54 to be bolted to the structure to be protected from lightning. By way of illustration, the fifth embodiment of electrical dissipater of the invention may be easily bolted to antennas, towers, metal buildings, metal cap rails or the like allowing electrical energy to flow therefrom to the bracket 54 to be dissipated at the terminal ends 46 of the multiplicity of wires 14.

Figure 3A:
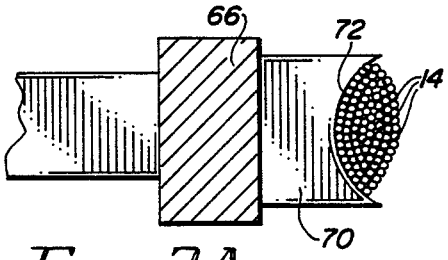
FIG. 3A is a partial cross-sectional view of FIG. 3 along lines 3A—3A illustrating the standoffs mounted to the take-up spool.
Figure 3:
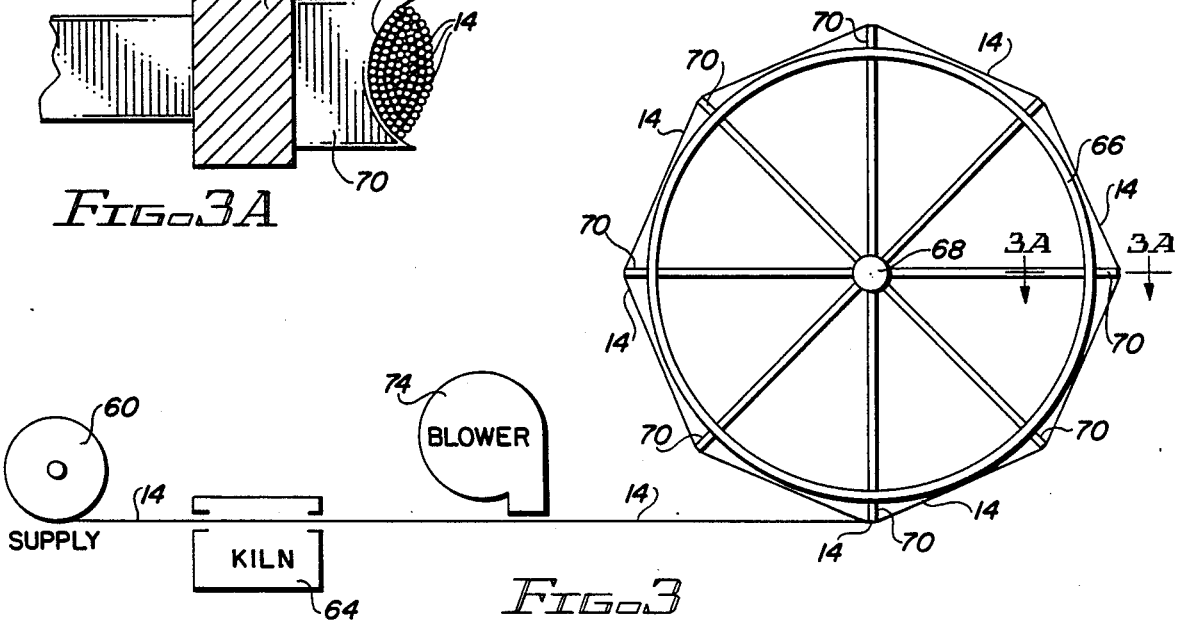
FIG. 3 is a diagrammatic view illustrating the method of the invention for producing the strands of fine conductive wire.

The method of the invention for producing straight tempered wires 14 for use with the various embodiments of electrical dissipater 10 of the invention, is diagrammaticly illustrated in FIGS. 3 and 3A. More specifically, a supply spool 60 of the conductive wire 14 is mounted on a spindle 62. The wire 14 from the supply spool 60 is run through a heat source (kiln) 64 operating at approximately 1550 degrees Fahrenheit. The wire 14 is then wound upon a take up spool 66 driven by motor 68. Preferably, take up spool 66 includes a large diameter approximately equal to 30 inches or greater. As shown in FIG. 3A, take up spool 66 preferably comprises a plurality of stand offs 70 equally spaced about the periphery of the spool 66 at incremetal distances of the intended length of the wires 14. Each standoff 70 includes a recessed portion 72 to force accumulation of the wire 14 wound on the take up spool 66.

During operation, take up spool 66 is rotated by means of motor 68 to draw the wire 14 through the heat source 64. As the wire 14 passes through the heat source 64, it is heated to approximately the temperature of the heat source 64. As the heated wire 14 exits from the heat source 64, it is rapidly cooled by exposure to the ambient temperature of the air. However, an air blower 74 may be provided to more rapidly cool the wire 14 prior to being wound upon the take up spool 66. Once the recess portion 72 of the standoff 70 are filled with wound wire 14, the take up spool 66 is stopped. The wire 14 is banded at each standoff 70. The bundle 22 of wires 14 thus formed may then be cut at each standoff 70, or every other standoff 70, to produce bundles 22 of wires 14 having a desired length.

The method of the invention as described hereinabove results in bundles of relatively straight wires 14. The wires retain their straightness and do not easily bend and tangle as they otherwise would without tempering.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. An electrostatic dissipator for dissipating electrical charge from a structure to the atmosphere to minimize lightning strikes, comprising in combination:

an electrically conductive base member including an upper end and a lower end;

means for mounting said lower end of said base member relative to the structure to be protected;

said upper end of said base member comprising an upwardly opened hole;

a plurality of long fine electrically conductive metal, untwisted wires each having a proximal end and a terminal end, the proximal ends of which are bunched together to be in electrical connection with sand fitted into said hole; and means for electrically and mechanically connecting said proximal ends of said wires positioned in said hole allowing said wires to emanate upwardly therefrom in a uniform, mushroom-shaped manner.

2. The dissipator as set forth in claim 1, wherein said base member comprises a tube and wherein said hole comprises the longitudinal opening through said tube.

3. The electrical dissipator as set forth in claim 2, wherein said electrical and mechanical connecting means comprises a mechanical crimp which deforms said hole to rigidly retain and electrically interconnect said wires therein.

4. The dissipator as set forth in claim 3, wherein said lower end of said base member is threaded for threaded engagement with a mounting fixture fastened to the structure to be protected.

5. The dissipator as set forth in claim 3, wherein said mounting means comprises said longitudinal opening of said tube dimensioned to fit over a conventional lightning rod mounted to the structure to be protected.

6. The dissipator as set forth in claim 3, further including a threaded plug for insertion into said lower end of said tube and wherein said mounting means comprises threaded engagement of said threaded plug into a threaded mounting fixture affixed to the structure to be protected.

7. The dissipator as set forth in claim 1, wherein said base member comprises a rod and wherein said mounting means comprises the lower end of said rod for threaded engagement with a mounting fixture affixed to the structure to be protected.

8. The dissipator as set forth in claim 7, wherein said electrical and mechanical means comprises a mechanical crimp which deforms said hole to rigidly retain and electrically interconnect said wires therein.

9. The dissipator as set forth in claim 1, wherein said base member comprises a flange at said lower end, said flange including mounting holes allowing said flange to be mounted to the structure to be protected.

10. The dissipator as set forth in claim 9, wherein said base member is manufactured from a tube having said lower end flattened to form said flange.

* * * * *

UNITED STATES PATENT AND TRADEMARK OFFICE

CERTIFICATE OF CORRECTION

PATENT NO. : 4,910,636

DATED : March 20, 1990

INVENTOR(S): Sadler, et al.

It is certified that error appears in the above-identified patent and that said Letters Patent is hereby corrected as shown below:

In Claim 1, Column 7, line 7, "sand" should be --and--.

Signed and Sealed this

Nineteenth Day of August, 1997

Bruce Lehman

*Attest:*

BRUCE LEHMAN

*Commissioner of Patents and Trademarks*

*Attesting Officer*